US006062243A

United States Patent [19]

Tuch et al.

[11] Patent Number: 6,062,243

[45] Date of Patent: May 16, 2000

[54] FLOATING SHELTER

[75] Inventors: Kenneth L. Tuch; Donald C. Tuch; Edward S. Tuch, all of Van Nuys, Calif.

[73] Assignee: The Eskott Company, Van Nuys, Calif.

[21] Appl. No.: 09/065,829

[22] Filed: Apr. 24, 1998

[51] Int. Cl.[7] ..... E04H 15/36

[52] U.S. Cl. ..... 135/124; 52/86; 135/123

[58] Field of Search ..... 135/96, 16, 123, 135/124, 138; 4/498; 441/38; 52/86

[56] References Cited

U.S. PATENT DOCUMENTS 5,570,544 11/1996 Hale ..... 52/218

5,595,203 1/1997 Espinosa ..... 135/124

5,690,133 11/1997 Capwell .

*Primary Examiner*—Beth Aubrey

*Attorney, Agent, or Firm*—Lyon & Lyon LLP

[57] ABSTRACT

A floating shelter has a semicircular frame defining an open-ended tunnel with an unobstructed ingress and egress. The frame has straight frame members forming the base of the open-ended tunnel. The roof of the open-ended tunnel is formed by curved frame members working together with a canopy top. A tensioning assembly mounted to each bottom corner of the canopy top engages the curved frame members forming the entrance and exit of the tunnel. Floats are fitted about the straight frame members forming the base of the open-ended tunnel for flotation of the frame.

29 Claims, 5 Drawing Sheets

FLOATING SHELTER

BACKGROUND OF THE INVENTION

The field of the present invention generally relates to shelters and more particularly to floating shelters.

The great outdoors is a wonderful place to be on a beautiful sunny day. There is nothing like the warmth of the sun to lift one's spirits. Too much sun on the body, however, can be detrimental. In no time at all, the sun's radiation can burn the skin. And this risk of being burned only increases when in water due to the reflection of the sun's rays against the water's surface. Knowing all about the dangers of the sun's radiation, creams and lotions are applied to block the damaging effects of the sun. In the fight to remain outdoors in the sun, umbrellas and other commonly known shading devices are also used. Most of these devices are meant to be used on land, not on water. The same can be said of commonly known shelters designed to protect an individual from the elements when the weather takes a turn for the worse. While shelters abound on land, temporary shelters on water are almost non-existent.

One attempt at a floating shading device is disclosed in U.S. Pat. No. 5,690,133 issued on Nov. 25, 1997 to Bruce Capwell. The device disclosed by Capwell includes a frame having oppositely disposed longitudinal frame members and oppositely disposed transverse frame members defining a perimeter in which a user places a raft or the like. The user then has to disadvantageously crawl over, or swim under, the frame members in order to enter into the confined user area to have access to their raft. The Capwell device is particularly designed to enable the user to fall asleep while floating on their raft without having to worry about floating away from the confined user area. Due to the obstructed ingress and egress, this shading device does not appear to be suited for an active individual. Furthermore, an individual on the water looking for a temporary shelter, such as somebody in or on a small water craft, would be discouraged from using the device disclosed by Capwell due to the difficulty in entering and exiting the confined user area.

Thus, the present inventors have recognized the desirability of a floating shelter solving the aforementioned problems to further enhance the enjoyment of the great outdoors.

SUMMARY OF THE INVENTION

The present invention is directed to a floating shelter having a semicircular frame defining an open-ended tunnel advantageously providing the user with an unobstructed ingress and egress. The frame has straight frame members forming the base or foundation of the open-ended tunnel. The roof of the open-ended tunnel is preferably formed by curved or bent frame members working together with a canopy top. In particular, the curved frame members are connected to the straight frame members by a plurality of connectors. The curved frame members forming the entrance and exit of the tunnel are inserted into a sleeve formed in the front and rear of the canopy top, respectively. A tensioning assembly is mounted preferably to each bottom corner of the canopy top for biasing the ends of the curved frame members forming the entrance and exit of the tunnel towards one another.

Advantageously, the canopy top not only forms part of the roof of the tunnel but also maintains the semicircular shape of the frame. A plurality of floats are preferably fitted about the straight frame members forming the base of the tunnel for flotation of the frame. The present invention is also lightweight and easy to assemble, providing the user with a portable floating shelter that can be quickly set up without the use of tools.

Accordingly, it is an object of the present invention to provide a shelter which protects the user from the elements while on the water. Other and further objects and advantages of the present invention will be further understood and appreciated by those skilled in the art by reference to the following specification, claims, and annexed drawings.

BRIEF DESCRIPTION OF THE DRAWINGS

Similar reference characters denote corresponding features consistently throughout the drawings.

DETAILED DESCRIPTION OF THE PREFERRED EMBODIMENT

Figure 1:
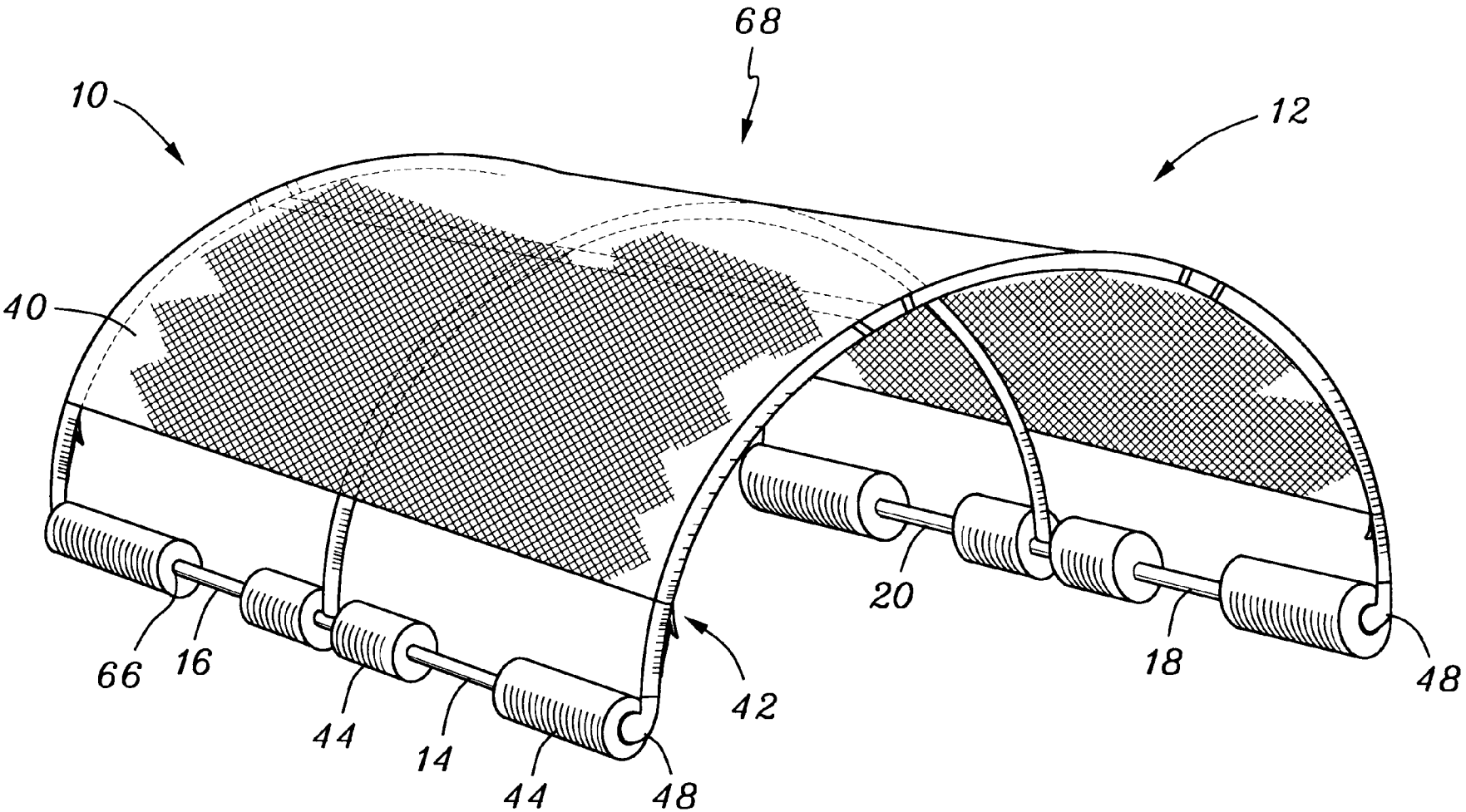
FIG. 1 is a perspective view according to a preferred embodiment of the present invention.
Figure 2:
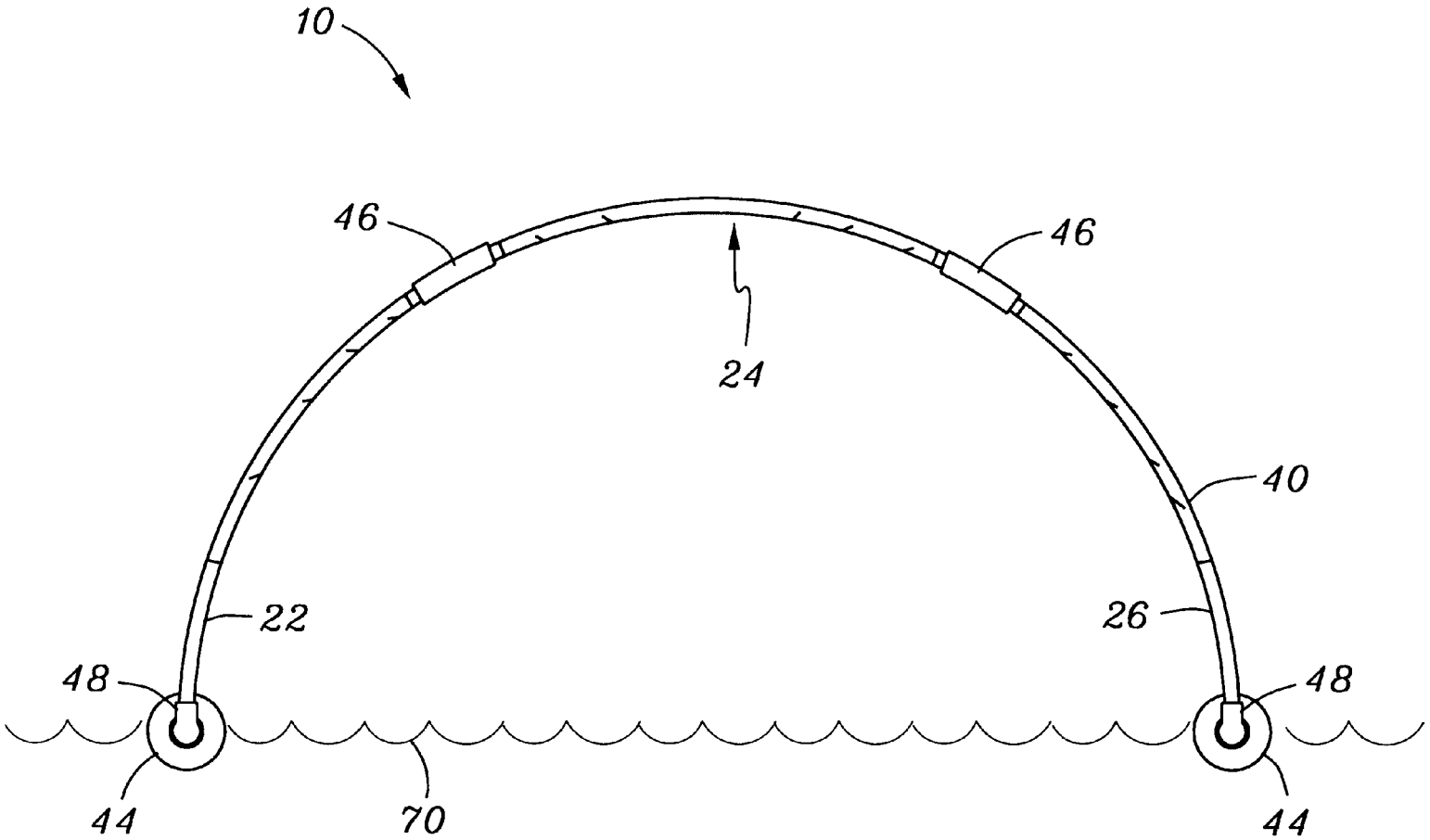
FIG. 2 is an environmental front view of the invention shown in FIG. 1.
Figure 3:
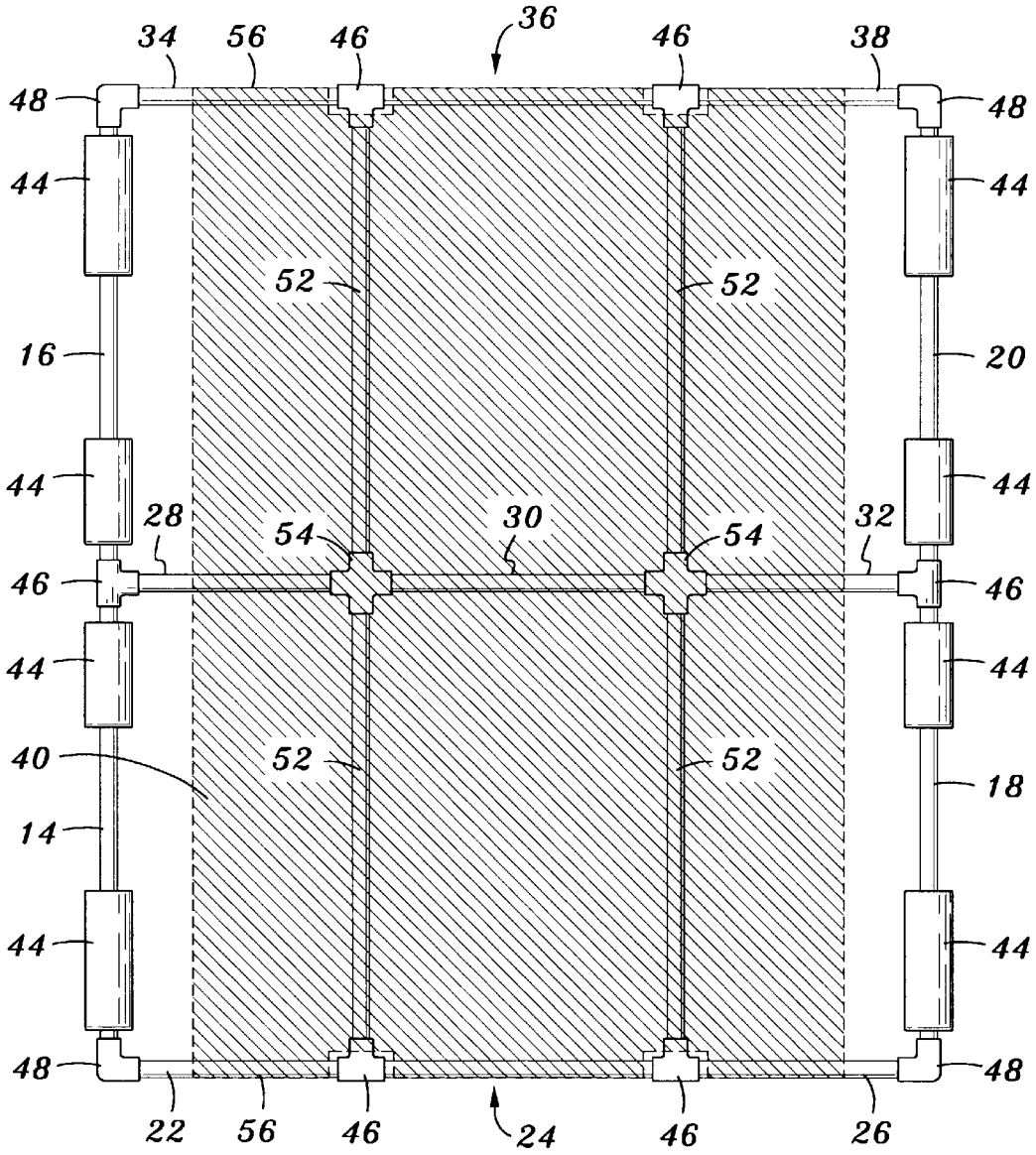
FIG. 3 is a top view of the invention shown in FIG. 1.

The preferred embodiment will now be described with reference to the drawings. In FIGS. 1 through 3, a floating shelter 10 is shown including a semicircular frame 12 defining an open-ended tunnel having an unobstructed ingress and egress. The base of the open-ended tunnel is formed by a plurality of straight frame members 14, 16, 18, 20. The roof of the open-ended tunnel is preferably formed by curved frame members 22, 24, 26, and 34, 36, 38 working together with a canopy top 40. A tensioning assembly 42 mounted preferably to each bottom corner of the canopy top 40 engages the curved frame members 22, 24, 26 and 34, 36, 38 forming the entrance and exit of the tunnel. Floats 44 are fitted about the straight frame members 14, 16, 18, 20 forming the base of the open-ended tunnel for flotation of the frame 12.

Turning in detail to FIG. 3, the lower left base of the open-ended tunnel is formed by straight frame members 14, 16 joined together by a three way tee connector 46. Parallel to and spaced apart from the lower left base is the lower right base of the open-ended tunnel. The lower right base is a mirror image of the lower left base with two straight frame members 18, 20 joined together by a three way tee connector 46 at one end of each straight frame member 18, 20. At the end of each straight frame member 14, 16, 18, 20 of the base opposite the three way tee connector 46 is a two way right angle connector 48. The two way right angle connector 48 orthogonally joins together the curved frame members 22, 24, 26 and 34, 36, 38 forming the entrance and exit of the open-ended tunnel, respectively. These curved frame members 22, 24, 26 and 34, 36, 38 forming the entrance and exit are parallel to and spaced apart from each other such that a rectangular shape is created, as seen in top view in FIG. 3, when joined to the straight frame members 14, 16, 18, 20 forming the base of the open-ended tunnel.

The entrance to the open-ended tunnel is particularly formed by three curved frame members 22, 24, 26 joined together by two three way tee connectors 46. A middle curved frame member 24 has one end joined to a lower left curved frame member 22 by a three way tee connector 46. The other end of the middle curved frame member 24 is joined to a lower right curved frame member 26 by another three way tee connector 46. The lower left curved frame member 22 is connected to the front left straight frame member 14 by the front left two way right angle connector 48. The lower right curved frame member 26 is connected to the front right straight frame member 18 by the front right two way right angle connector 48. The lower left and lower right curved frame members 22, 26 each have a bore 50 for engaging the tensioning assembly 42, discussed in detail when referring to FIG. 5 below. The exit of the open-ended tunnel is structurally identical to the entrance of the open-ended tunnel and is a mirror image thereof. While the curved frame members 22, 24, 26 and 34, 36, 38 forming the entrance and exit of the open-ended tunnel do serve to define a portion of the roof of the tunnel, the remaining structural components of the roof preferably include a centrally disposed curved framing section 68, a plurality of spacers 52 joined to the centrally disposed curved framing section 68, and the canopy top 40.

As shown in FIG. 3, the centrally disposed framing section 68 is formed by three curved frame members 28, 30, 32 joined together by two four way cross connectors 54. A middle curved frame member 30 has one end joined to a left curved frame member 28 by a four way cross connector 54. The other end of the middle curved frame member 30 is joined to a right curved frame member 32 by another four way cross connector 54. The left curved frame member 28 is orthogonally connected to the straight frame members 14, 16 forming the left side of the base of the open-ended tunnel by the three way tee connector 46 joining together the straight frame members 14, 16. The right curved frame member 32 is orthogonally connected to the straight frame members 18, 20 forming the right side of the base of the open-ended tunnel by the three way tee connector 46 joining together the straight frame members 18, 20. As such, the centrally disposed framing section 68 is orthogonally joined to the straight frame members 14, 16, 18, 20 forming the base of the open-ended tunnel while equidistantly spaced apart and parallel to the curved frame members 22, 24, 26 and 34, 36, 38 forming the entrance and exit of the open-ended tunnel.

Four spacers 52 are in communication with the centrally disposed framing section 68 and the curved frame members 22, 24, 26 and 34, 36, 38 forming the entrance and exit of the open-ended tunnel. These spacers 52 are straight frame members respectively connected at the four way cross connectors 54 and the three way tee connectors 46 of the curved frame members 22, 24, 26 and 34, 36, 38 forming the entrance and exit of the open-ended tunnel. When connected, the spacers 52 are spaced apart and parallel to one another while equidistantly spaced from the straight frame members 14, 16, 18, 20 forming the base of the open-ended tunnel and the curved frame members 22, 24, 26 and 34, 36, 38 forming the entrance and exit of the open-ended tunnel.

The canopy top 40 has a front and rear sleeve 56 formed by folding over and stitching the canopy top 40 about itself. The curved framing members 22, 24, 26 and 34, 36, 38 forming the entrance and exit of the open-ended tunnel are respectively inserted into the sleeve 56 during assembly of the floating shelter 10. While not shown in the drawings, the canopy top can be combined with a drop cloth or the like extending downwardly from each sleeve 56 in order to provide the user with additional protection from the elements.

Figure 4:
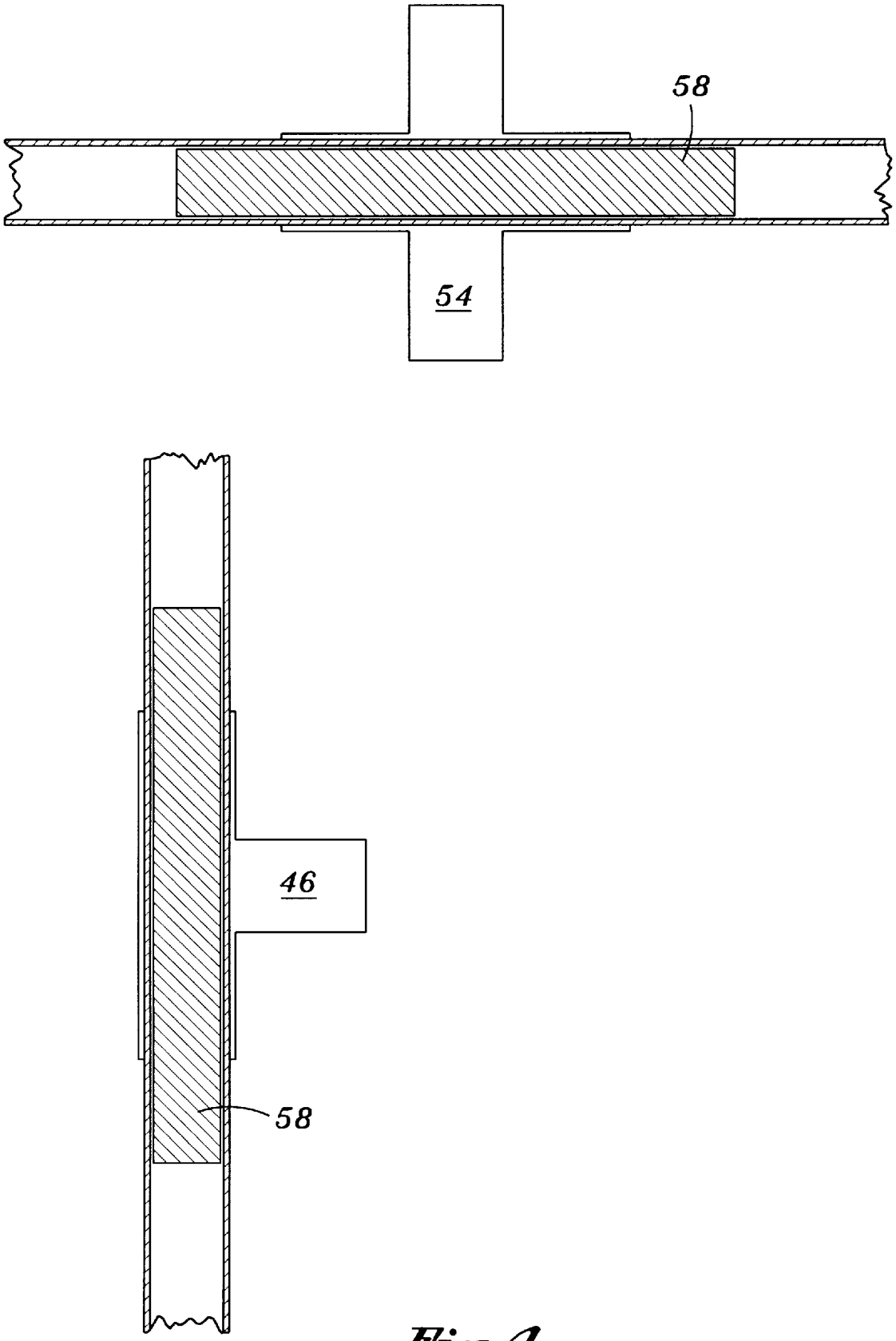
FIG. 4 is a detailed view of the four way cross connector and the three way tee connector each having an inside frame support used in the invention shown in FIG. 1.

Turning in detail to FIG. 4, inside frame supports 58 are preferably used to maintain the structural integrity of the semicircular frame 12 at the junctions of the straight and curved frame members 14, 16, 18, 20 and 22, 24, 26, 28, 30, 32, 34, 36, 38 where the three way tee connectors 46 and four way cross connectors 54 are used. Each inside frame support 58 is inserted through the respective connector 46, 54 and is of such a length that the support 58 spans or extends beyond two opposing openings of the connector 46, 54 and into the respective straight and curved frame members 14, 16, 18, 20 and 22, 24, 26, 28, 30, 32, 34, 36, 38.

Figure 5:
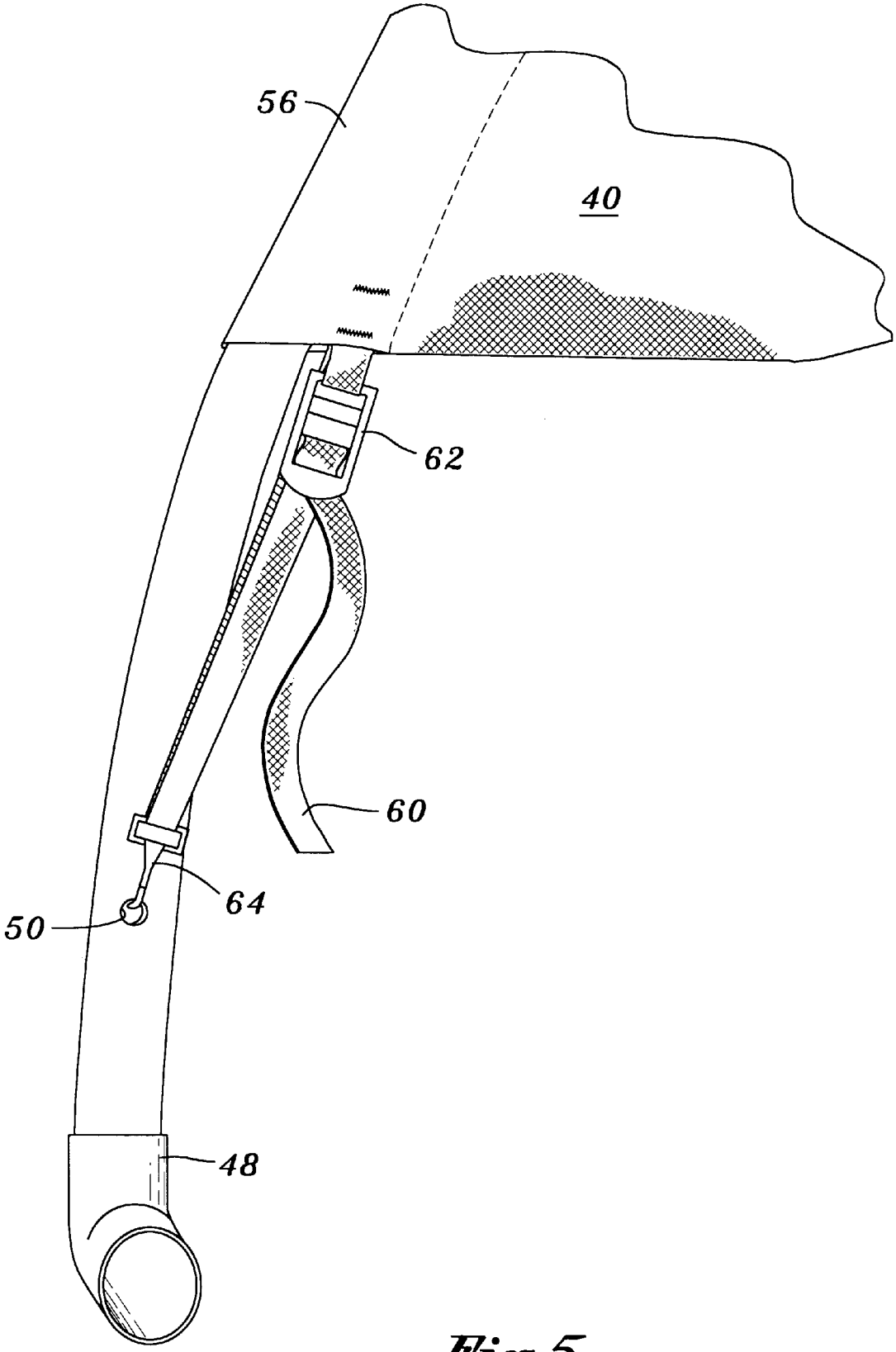
FIG. 5 is a detailed view of the tensioning assembly shown in FIG. 1.

Turning in detail to FIG. 5, the tensioning assembly 42 has a strap 60 sewn onto each of the four bottom corners of the canopy top 40. Each strap 60 of the tensioning assembly 42 is woven through a buckle 62. A hook 64 is mounted to each strap 60. The hook 64 engages the bore 50 of the lower left and right curved frame members 22, 26, 34, and 38 for adjustably tensioning the canopy top 40 about the spacers 52 and the curved frame members 22, 24, 26, and 34, 36, 38. Advantageously, the tensioning assembly 42 biases the ends of curved frame members 22, 26 towards one another such that the semicircular shape of the frame 12 is maintained. In an identical fashion, the tensioning assembly 42 biases the ends of curved frame members 34, 38 towards one another such that the semicircular shape of the frame 12 is maintained. Advantageously, the canopy top 40 is an integral structural element of the roof of the open-ended tunnel. Such an arrangement provides the user with a means of adjustably maintaining the shape of the semicircular frame 12.

As shown in FIGS. 1 through 3, eight floats 44 are preferably disposed about the straight frame members 14, 16, 18, 20 forming the base of the open-ended tunnel for flotation of the semicircular frame 12. Each float 44 has a throughbore 66 which is adapted to receive the respective straight frame member 14–20. A first set of four floats 44 is symmetrically disposed proximate the three way tee connector 46 joining together the straight frame members 14, 16, 18, 20. In particular, two identical floats 44 are disposed oppositely each three way tee connector 46. A second set of four floats 44 has one float symmetrically disposed proximate the two way right angle connector 48 joining together the straight and curved frame members 14, 16, 18, 20 and 22, 26, 34, and 38. Such an arrangement has been found to provide the proper amount of flotation and stability of the semicircular frame 12.

In construction, the straight and curved frame members 14, 16, 18, 20 and 22, 24, 26, 28, 30, 32, 34, 36, 38, the plurality of connectors 46, 48, 54, and the plurality of inside frame supports 58 are preferably made of common grade plastic known as polyvinylchloride (PVC). PVC is preferred over other frame materials such as aluminum and galvanized steel due to its strength factor, costs of fabrication, weight, electrical conductivity, and chemical resistance to corrosion caused by chlorine and other commonly used pool chemicals. The weight of the frame 12 is presently about thirty pounds for purposes of portability and shipping. The canopy top 40 is preferably made of reinforced vinyl covered tenting material for blocking substantially all ultraviolet radiation of sunlight and for resisting fading due to the sun's radiation. This canopy top material is particularly suited for its weight and shear strength which is necessary to withstand the increased load applied by the tensioning assembly 42. The floats 44 are made of a polyethylene foam designed to withstand damage caused by chemicals, water, and the sun's radiation.

With respect to the dimensions of the semicircular frame structural components, the semicircular frame 12 is preferably about eight feet wide by ten feet long. The inside diameter of the open-ended tunnel is preferably ninety-six inches. These dimensions have been found to create a sufficient amount of head clearance for the user, while maintaining the designed shape of the semicircular frame 12. Furthermore, with eighty square feet of protection, an active individual in or on a small water craft, such as a kayak, ski boat, fishing boat or the like, can advantageously use the present invention as a temporary shelter against the elements. The inside frame supports 58 are preferably ten inches in length for maintaining structural integrity. These preferred frame dimensions, in combination with the tensioning assembly 42, prevent the frame 12 from spreading out and losing its shape, especially during intense summer heat.

With respect to the dimensions of the floats 44, the floats 44 are preferably cylindrical in shape with a diameter of six inches. Two sets of floats 44, one set preferably at twenty-four inches in length and the other set preferably at eight inches in length, have been found to provide the proper amount of flotation and stability of the semicircular frame 12.

In assembly and operation of the floating shelter 10, the user slides the lower left and right curved frame members 22, 26, 34, 38 and the middle frame member 24, 36 forming the entrance and exit of the open-ended tunnel into the sleeves 56 of the canopy top 40. These frame members are then respectively joined together via four three-way tee connectors 46 and four inside frame supports 58. Next, the user connects the three curved frame members 28, 30, 32 forming the centrally disposed frame section using the two four-way cross connectors 54. The user then connects the four spacers 52 to the three way tee connectors 46 and four way cross connectors 54, respectively. A twenty four inch float 44 and an eight inch float 44 are then slid onto each of the four straight frame members 14, 16, 18, 20 forming the base of the open-ended tunnel. Two of these four straight frame members 14, 16, 18, 20 are then joined together via a three way tee connector 46. The four two-way right angle connectors 48 are then used to join together the straight frame members 14, 16, 18, 20 to the curved frame members 24, 26, 34, 38 forming the entrance and exit of the open-ended tunnel. Glue, preferably PVC based, is used to connect each of the four two-way right angle connectors 48 at curved frame members 22, 26, 34, 38. The user then adjusts the inner diameter of the open-ended tunnel to ninety-six inches and fastens the straps 60 of each tensioning assembly 42 as necessary.

Advantageously, the user has quickly and easily assembled the present invention without having to use tools. Once assembled, the user can be protected from the elements while on land, water 70 (shown in FIG. 2), or a combination of both such as half on land and half in a pool. Furthermore, the user of the present invention is advantageously able to enter and exit the open-ended tunnel defined by the semicircular frame 12 without any impediments or obstructions blocking the respective ingress and egress. An active individual can thus quickly and easily move through the open-ended tunnel defined by the present invention. Furthermore, if placed in water, an active individual on a small water craft such as a ski boat or fishing boat can use the present invention as a temporary shelter without having to get out of their water craft. While not shown in the drawings, more than one floating shelter 10 can be assembled and connected together so that an active individual wishing to swim laps, for example, may be able to do so while protected from the elements. In addition, while not shown in the drawings, an anchoring system may be employed to keep the floating shelter 10 in a desired position, such as by attaching a plurality of weights or tie-downs to the frame 12. To prolong the life of the present invention, it is recommended that the present invention not be placed in a pool when adding pool chemicals. It is also recommended that the present invention not be used in the wind.

Thus, a floating shelter which protects the user from the elements has been disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A shelter comprising:

first and second frame members spaced apart from one another;

third and fourth frame members spaced apart from one another, the third and fourth frame members each having a first end and a second end, the first end and the second end connected to the first and second frame members; and a canopy top biasing the first end of the third and fourth frame members towards the second end of the third and fourth frame members to define the roof of an open-ended tunnel free of obstructions between the first frame member and the second frame member, whereby a user has unrestricted access into and out of the tunnel.

2. The shelter according to claim 1, further comprising a tension assembly mounted to the canopy top for adjustably biasing the first end of the third and fourth frame members towards the second end of the third and fourth frame members.

3. The shelter according to claim 2, wherein the tension assembly includes a buckle, a strap woven through the buckle, and a hook connected to the strap.

4. The shelter according to claim 3, wherein the third and fourth frame members each have a bore proximate each end for receiving the hook of the tension assembly.

5. The shelter according to claim 1, wherein the first and second frame members are adapted for flotation of the shelter.

6. The shelter according to claim 5, wherein the first and second frame members are adapted for flotation of the shelter via floats disposed about the first and second frame members.

7. The shelter according to claim 6, wherein each of the plurality of floats has a throughbore, the first and second frame members respectively inserted through each throughbore for stabilizing the shelter while afloat.

8. The shelter according to claim 6, wherein each of the plurality of floats are about six inches in diameter and between about eight to about twenty-four inches in length.

9. The shelter according to claim 1, wherein the canopy top is made of reinforced vinyl covered tenting material for blocking substantially all ultraviolet radiation of sunlight.

10. The shelter according to claim 1, wherein the canopy top is about eight feet wide by about ten feet long.

11. The shelter according to claim 1, wherein the third and fourth frame members each have a first curved section, a second curved section, and a third curved section, the first curved section connected to the second curved section by a first three way tee connector, the second curved section connected to the third curved section by a second three way tee connector.

12. The shelter according to claim 11, wherein the first curved section and the second curved section each have a bore for receiving a hook of a tension assembly.

13. The shelter according to claim 11, further comprising a plurality of inside frame supports housed within the third and fourth frame members for additional support at each three way tee connector.

14. The shelter according to claim 1, wherein the first and second frame members each have a first straight section and a second straight section, the first straight section connected to the second straight section by a three way tee connector.

15. The shelter according to claim 14, further comprising a plurality of inside frame supports housed within the first and second frame members for additional support at each three way tee connector.

16. The shelter according to claim 1, further comprising a fifth frame member orthogonally connected to the first and second frame members between the third and fourth frame members.

17. The shelter according to claim 16, wherein the fifth frame member has a first curved section, a second curved section, and a third curved section, the first curved section connected to the second curved section by a first four way cross connector, the second curved section connected to the third curved section by a second four way cross connector.

18. The shelter according to claim 17, wherein the fifth frame member is in communication with the third and fourth frame members at each four way cross connector.

19. A floating canopy comprising:

a semicircular frame defining an open-ended tunnel having an unobstructed ingress and egress, wherein the frame includes:

a) first and second straight framing sections joined together by a first three way tee connector for forming a lower left foundation of the open-ended tunnel;

b) third and fourth straight framing sections joined together by a second three way tee connector for forming a lower right foundation of the open-ended tunnel;

c) a plurality of bent framing sections linking the first and second straight frame sections to the third and fourth straight framing sections for forming part of the roof of the open-ended tunnel;

d) a canopy top having a front sleeve and a rear sleeve, each sleeve receiving at least two bent framing sections for stretching the canopy top about the plurality of bent framing sections to finish forming the roof of the open-ended tunnel; and e) a tensioning assembly mounted to the canopy top near the junction of the bent framing sections and the straight framing sections for maintaining the shape of the open-ended tunnel; and a plurality of floats disposed about each of the straight framing sections for flotation of the semicircular frame.

20. The floating canopy according to claim 19, wherein the tensioning assembly has a strap sewn onto the canopy top, a buckle in communication with the strap, and a hook mounted onto the strap.

21. The floating canopy according to claim 20, wherein at least two bent framing sections have a hole for engaging the hook of the tensioning assembly.

22. The floating canopy according to claim 19, further comprising a plurality of three way tee connectors and four way cross connectors joining together the plurality of bent framing sections.

23. The floating canopy according to claim 19, further comprising a plurality of three way tee connectors and two way right angle connectors orthogonally joining the plurality of bent framing sections to each of the straight framing sections.

24. The floating canopy according to claim 19, further comprising a plurality of straight spacers orthogonally linked to the plurality of bent framing sections for supporting the canopy top.

25. The floating canopy according to claim 19, further comprising a plurality of inside framing supports housed within the plurality of bent framing sections at each point of connection.

26. The floating canopy according to claim 19, further comprising an inside frame support housed within each of the straight framing sections at each three way tee connector.

27. A shelter comprising:

first and second frame members spaced apart from one another;

a plurality of floats disposed about the first and second frame members for flotation of the shelter;

third and fourth frame members spaced apart from one another, the third and fourth frame members each having a first end and a second end, the first end and the second end connected to the first and second frame members; and a canopy top biasing the first end of the third and fourth frame members towards the second end of the third and fourth frame members to define the roof of an open-ended tunnel, whereby a user has unrestricted access into and out of the tunnel.

28. The shelter according to claim 27, further comprising a tension assembly mounted to the canopy top for adjustably biasing the first end of the third and fourth frame members towards the second end of the third and fourth frame members.

29. A shelter comprising:

first and second frame members spaced apart from one another;

third and fourth frame members spaced apart from one another, the third and fourth frame members each having a first end and a second end, the first end and the second end connected to the first and second frame members;

a canopy top biasing the first end of the third and fourth frame members towards the second end of the third and fourth frame members to define the roof of an open-ended tunnel; and a tension assembly mounted to the canopy top for adjustably biasing the first end of the third and fourth frame members towards the second end of the third and fourth frame members, whereby a user has unrestricted access into and out of the tunnel.

* * * * *